US012018679B2

(12) United States Patent
Ishihara et al.

(10) Patent No.: US 12,018,679 B2
(45) Date of Patent: Jun. 25, 2024

(54) VANE PUMP

(71) Applicant: DENSO CORPORATION, Kariya (JP)

(72) Inventors: Keiichirou Ishihara, Kariya (JP); Tomohiro Itoh, Kariya (JP); Yasuo Kato, Kariya (JP); Masahiro Satou, Kosai (JP)

(73) Assignee: DENSO CORPORATION, Kariya (JP)

( * ) Notice: Subject to any disclaimer, the term of this patent is extended or adjusted under 35 U.S.C. 154(b) by 224 days.

(21) Appl. No.: 17/586,093

(22) Filed: Jan. 27, 2022

(65) Prior Publication Data

US 2022/0145883 A1 May 12, 2022

Related U.S. Application Data

(63) Continuation of application No. PCT/JP2020/028788, filed on Jul. 28, 2020.

(30) Foreign Application Priority Data

Aug. 8, 2019 (JP) ..... 2019-146174

(51) Int. Cl.
*F04C 14/08* (2006.01)
*F04C 2/344* (2006.01)
*F04C 15/00* (2006.01)

(52) U.S. Cl.
CPC ..... *F04C 14/08* (2013.01); *F04C 2/344* (2013.01); *F04C 15/0049* (2013.01); *F04C 2230/60* (2013.01); *F04C 2240/30* (2013.01); *F04C 2240/40* (2013.01)

(58) Field of Classification Search
CPC ..... F04C 2/344; F04C 18/344; F04C 14/08; F04C 15/0049; F04C 2230/60; F04C 2240/30
See application file for complete search history.

(56) References Cited

U.S. PATENT DOCUMENTS 8,549,896 B2 * 10/2013 Kobayashi ..... F01C 21/10 73/40.7
2007/0102060 A1 * 5/2007 Palmer ..... F04B 49/22 141/286
2011/0138885 A1 6/2011 Kobayashi et al.
2018/0347563 A1 * 12/2018 Wollmann ..... F04C 14/28

FOREIGN PATENT DOCUMENTS

JP S52-36308 3/1977
JP 2000-320480 11/2000
JP 2012-241172 12/2012

* cited by examiner

*Primary Examiner* — Charles G Freay
(74) *Attorney, Agent, or Firm* — Nixon & Vanderhye P.C.

(57) ABSTRACT

A vane pump includes a casing, a rotor, vanes, a motor, and a fixed member. The casing defines a pump chamber therein. The rotor is disposed in the casing and configured to eccentrically rotate relative to the casing. The vanes are configured to rotate together with the rotor to slidably move on an inner surface of the casing. The motor is configured to rotate the rotor. Both the motor and the casing are fixed to the fixed member. The casing has an outer side wall surface and a flange. The flange protrudes outward from the outer side wall surface at an intermediate position between both ends of the pump chamber in a rotational axis direction of the rotor. The flange is fixed to the fixed member at a plurality of positions. The fixed member has a linear expansion coefficient that is different from that of the casing.

8 Claims, 7 Drawing Sheets

VANE PUMP

CROSS REFERENCE TO RELATED APPLICATION

The present application is a continuation application of International Patent Application No. PCT/JP2020/028788 filed on Jul. 28, 2020, which designated the U.S. and claims the benefit of priority from Japanese Patent Application No. 2019-146174 filed on Aug. 8, 2019. The entire disclosures of all of the above applications are incorporated herein by reference.

TECHNICAL FIELD

The present disclosure relates to a vane pump.

BACKGROUND

A vane pump includes a casing, a rotor, and vanes. The casing of the vane pump is directly or indirectly fixed to a motor that rotates the rotor.

Depending on applications of the vane pump, it is important to suppress fluctuations in the discharge pressure.

SUMMARY

A vane pump includes a casing defining a pump chamber therein, a rotor disposed in the casing and configured to eccentrically rotate relative to the casing around a rotational axis, a plurality of vanes configured to rotate together with the rotor to slidably move on an inner surface of the casing, a motor configured to rotate the rotor, and a fixed member to which both the motor and the casing are fixed. The casing has an outer side wall surface and a flange. The flange protrudes outward from the outer side wall surface at an intermediate position between both ends of the pump chamber in a rotational axis direction of the rotor. The flange is fixed to the fixed member at a plurality of positions.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

To begin with, examples of relevant techniques will be described.

A vane pump includes a casing, a rotor, and vanes. The casing of the vane pump is directly or indirectly fixed to a motor that rotates the rotor. Depending on applications of the vane pump, it is important to suppress fluctuations in the discharge pressure.

In terms of the request to suppress fluctuations in the discharge pressure of the vane pump, the known vane pump has the following problems.

The casing may expand or contract along with temperature changes due to various factors. If the casing is fixed to a fixed member such as a motor housing, a pump chamber may be deformed when the casing expands or contracts.

Deformation of the pump chamber may lead to uneven changes in clearances between the casing and the rotor and between the casing and the vanes, depending on how the pump chamber is deformed. As a result, it may be difficult to suppress fluctuations in discharge pressure of the vane pump.

It is an objective of the present disclosure to provide a vane pump that can suppress fluctuations in discharge pressure due to temperature changes.

According to one aspect of the present disclosure, a vane pump includes a casing defining a pump chamber therein, a rotor disposed in the casing and configured to eccentrically rotate relative to the casing around a rotational axis, a plurality of vanes configured to rotate together with the rotor to slidably move on an inner surface of the casing, a motor configured to rotate the rotor, and a fixed member to which both the motor and the casing are fixed. The casing has an outer side wall surface and a flange. The flange protrudes outward from the outer side wall surface at an intermediate position between both ends of the pump chamber in a rotational axis direction of the rotor. The flange is fixed to the fixed member at a plurality of positions.

In the vane pump of the above aspect, the casing has the flange at the intermediate position and is fixed to the fixed member at the flange. As a result, when the casing expands or contracts due to a temperature change, it is easy to suppress an uneven deformation of the casing caused by a difference in linear expansion coefficient between the casing and the fixed member. As a result, the amount of deformation of the pump chamber can be suppressed. Therefore, it is possible to suppress fluctuations in discharge pressure of the vane pump 1 due to temperature changes.

As described above, according to the above aspect, it is possible to provide a vane pump that can suppress fluctuations in discharge pressure due to temperature changes.

First Embodiment

A vane pump of one embodiment will be described with reference to FIGS. 1 to 6.

Figure 1:
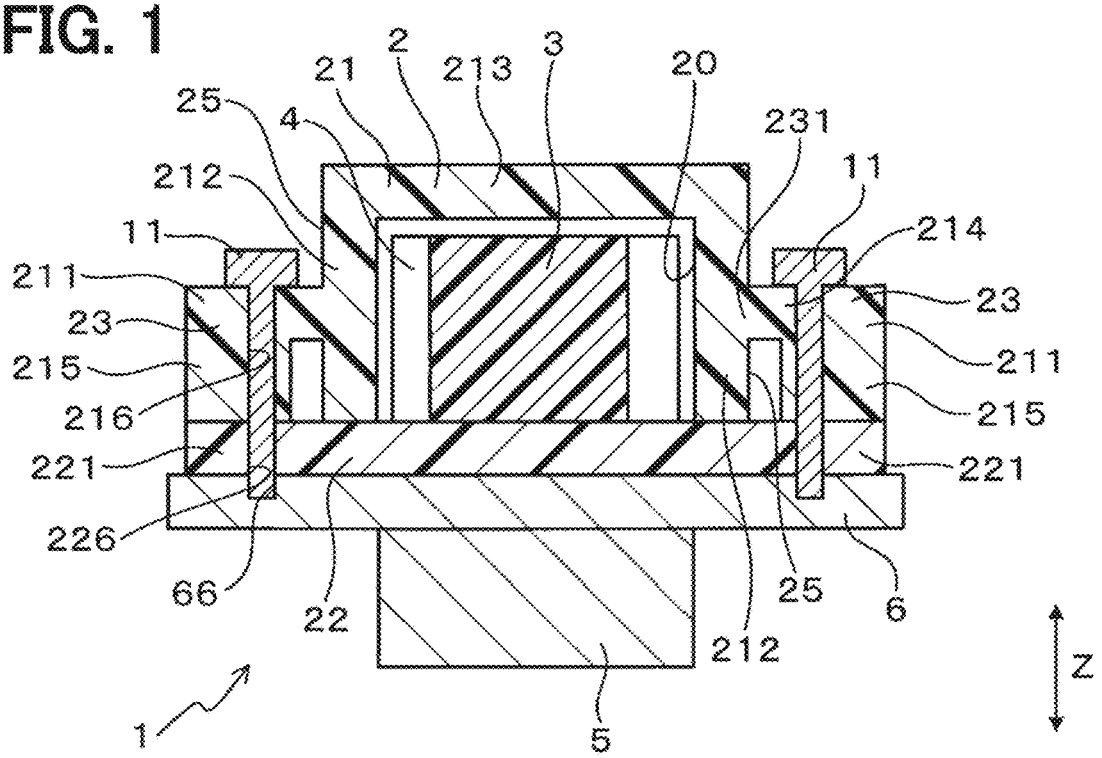
FIG. 1 is a cross-sectional explanatory view of a vane pump according to the first embodiment taken along a line I-I in FIG. 2.
Figure 2:
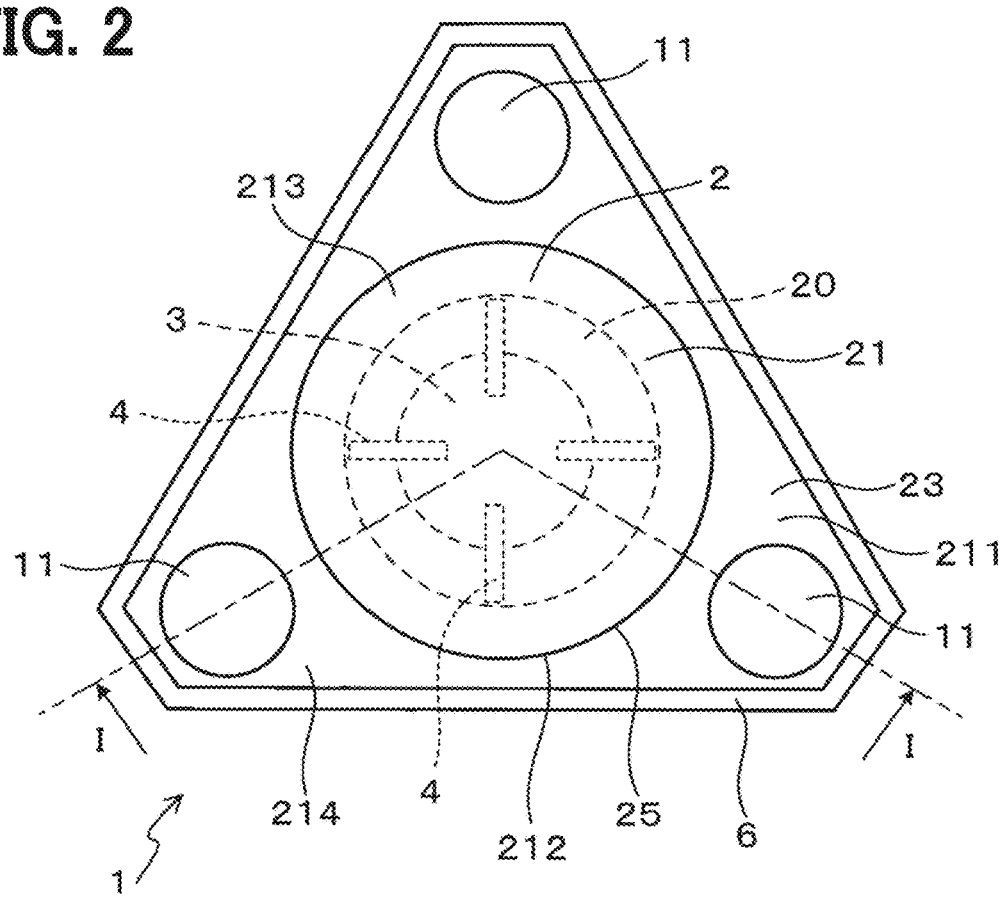
FIG. 2 is a plan explanatory view of the vane pump according to the first embodiment.

As shown in FIGS. 1 and 2, the vane pump 1 of the present embodiment includes a casing 2, a rotor 3, multiple vanes 4, a motor 5, and a fixed member 6.

The casing 2 defines a pump chamber 20 therein. The rotor 3 is arranged inside the casing 2 and rotates eccentrically with respect to the casing 2 around a rotational axis. Each of the vanes 4 rotates together with the rotor 3 and slidably moves on an inner surface of the casing 2. The motor 5 rotates the rotor 3. Both of the motor 5 and the casing 2 are fixed to the fixed member 6.

The casing 2 has an outer side wall surface 25 and a flange 23 defined as follows. That is, the flange 23 protrudes from the outer side wall surface 25 at an intermediate position between both ends of the pump chamber 20 in a rotational axis direction Z of the rotor 3. The flange 23 of the casing 2 is fixed to the fixed member 6 at multiple positions.

Hereinafter, the rotational axis direction Z of the rotor 3 is also appropriately referred to as an axial direction Z. As shown in FIG. 1, the flange 23 has a joint portion 231 connected to the outer side wall surface 25 of the casing 2. The joint portion 231 is located at the intermediate position that is closer to a middle position of the pump chamber 20 than to both ends of the pump chamber 20 in the axis direction X.

The casing 2, the rotor 3, and the vanes 4 are made of resin. Specifically, for example, the casing 2 is made of a phenol resin, and the rotor 3 and the vanes 4 are made of a PPS resin (i.e., a polyphenylenesulfide resin).

The motor 5 is arranged on one side of the casing 2 in the axial direction. The fixed member 6 is interposed between the motor 5 and the casing 2 in the axial direction Z. The fixed member 6 is made of a material having a linear expansion coefficient that is different from that of the casing 2. In this embodiment, the fixed member 6 is made of a metal material such as plated steel.

Then, the motor 5 and the casing 2 are fixed to the fixed member 6. That the motor 5 is fixed to the fixed member 6 means a state in which a stator of the motor 5 is directly or indirectly fixed to the fixed member 6. The state shown in FIG. 1 indicates a state in which housing of the motor 5 to which the stator is fixed is fixed to the fixed member 6. However, for example, the housing itself of the motor 5 may serve as the fixed member 6. In this case, the casing 2 may be fixed to the housing of the motor 5. In the present specification, for convenience, a side of the fixed member 6 on which the casing 2 is arranged along the axial direction Z is referred to an upside and the opposite side is referred to as a downside.

As shown in FIG. 1, the casing 2 has a first case 21 and a second case 22. The first case 21 and the second case 22 are fixed to each other in the axial direction Z. The first case 21 has a first flange 211. The first flange 211 protrudes outward from the outer side wall surface 25 of the casing 2. The second case 22 has a second flange 221. The second flange 221 protrudes outward from the outer side wall surface 25 of the casing 2. The first case 21 and the second case 22 are fixed to each other and fixed to the fixed member 6 at the first flange 211 and the second flange 221. At least one of the first flange 211 and the second flange 221 is the flange 23 at the intermediate position.

In this embodiment, the first flange 211 is the flange 23 at the intermediate position. On the other hand, in this embodiment, the second flange 221 is not the flange 23 at the intermediate position.

Figure 3:
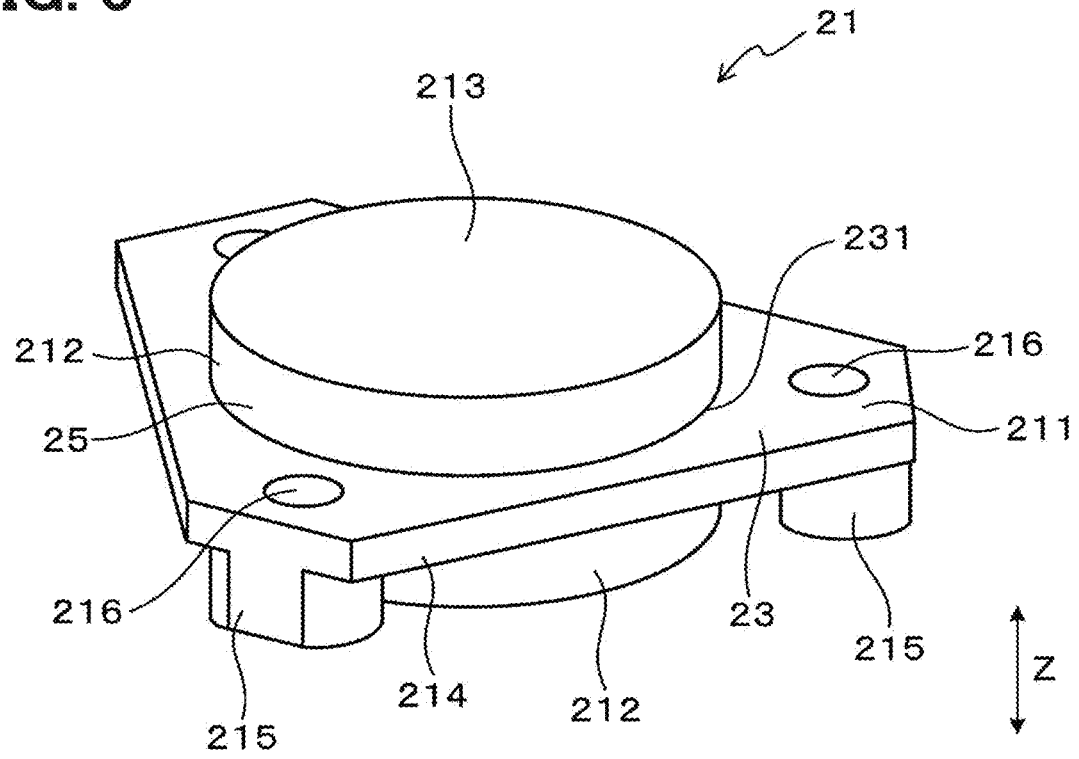
FIG. 3 is a perspective view of a first case in the first embodiment.

The second case 22 has a substantially flat plate shape. On the other hand, as shown in FIGS. 1 to 3, the first case 21 has an outer circumferential wall portion 212 and a top plate portion 213. The outer circumferential wall portion 212 has a substantially cylindrical shape having an inner circumferential surface substantially parallel to the axial direction Z. The top plate portion 213 has a substantially circular flat plate shape perpendicular to the axial direction Z. The top plate portion 213 is connected to the upper end of the outer circumferential wall portion 212. That is, the top plate portion 213 covers the upper portion of the pump chamber 20.

The outer surface of the outer circumferential wall portion 212 forms the outer side wall surface 25 of the casing 2. That is, the first flange 211 (i.e., the flange 23 at the intermediate position) protrudes outward from the outer circumferential wall portion 212. Further, as shown in FIG. 1, the lower end of the outer circumferential wall portion 212 is in contact with the upper surface of the second case 22. The lower end of the outer circumferential wall portion 212 is in contact with the upper surface of the second case 22 entirely in the circumferential direction. As a result, the pump chamber 20 is defined between the first case 21 and the second case 22.

Figure 4:
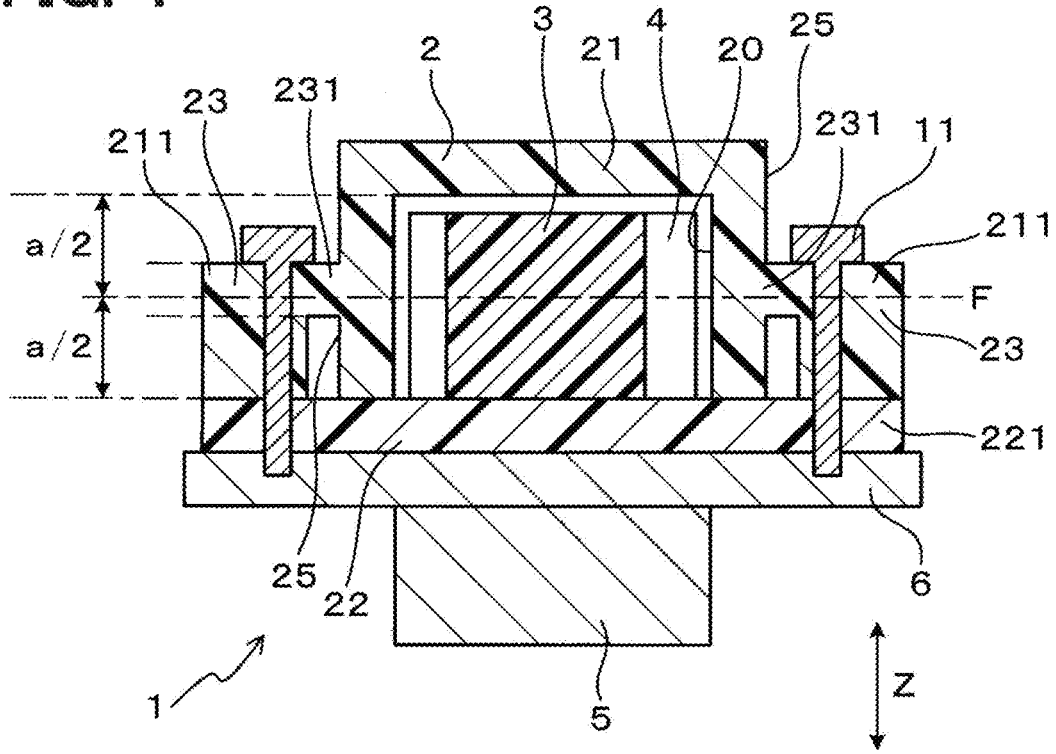
FIG. 4 is a cross-sectional explanatory view of the vane pump of the first embodiment illustrating a center plane.

Here, as shown in FIG. 4, a central plane F is defined as a plane that is perpendicular to the rotational axis and passes through a middle position of the pump chamber 20 in the axial direction. At least a part of the joint portion 231 of the flange 23 connected to the outer side wall surface 25 of the casing 2 is located on each side of the center plane F. That is, a part of the joint portion 231 is located on the upside of the central plane F and the other part of the joint portion 231 is located on the downside of the central plane F.

In this embodiment, the joint portion 231 of the first flange 211 that is the flange 23 at the intermediate position extends over the central plane F. In other words, the central plane F passes through the joint portion 231 of the flange 23 at the intermediate position.

As shown in FIG. 2, in this embodiment, the first flange 211 and the second flange 221 are continuously formed over the entire circumference of the outer side wall surface 25 of the casing 2, As shown in FIGS. 1 and 3, the first flange 211 includes a lateral protrusion 214 protruding outward from the joint portion 231 and leg portions 215 protruding downward in the axial direction Z from the lateral protrusion 214. The number of the leg portions 215 is three.

The first flange 211 and the second flange 221 overlap with each other in the axial direction Z and are in contact with each other at the three leg portions 215. The first flange 211 and the second flange 221 are fixed to the fixed member 6 at multiple contact points. That is, the contact points between the first flange 211 and the second flange 221 are fastened to the fixed member 6 by screws 11. The number of the fastening points, that is, the number of the leg portions 215 is three in this embodiment, but is not particularly limited and may be four or more. Alternatively, if the pump chamber 20 can be defined appropriately, the number of the fastening points may be two.

Each of the screws 11 is inserted into an insertion hole 216 of the first flange 211 and an insertion hole 226 of the second flange 221, and is screwed into a female screw 66 of the fixed member 6. As a result, the first flange 211 and the second flange 221 are fixed to the fixed member 6 in the axial direction Z, and the first flange 211 and the second flange 221 are fixed to each other. Although not shown, the screw 11 may pass through the fixed member 6 and be screwed into a nut arranged on a downside of the fixed member 6.

Further, in the state before fixing the first case 21 to the second case 22 or the like, the lower ends of the leg portions 215 are arranged slightly above the lower end of the outer circumferential wall portion 212. As a result, the lower end of the outer circumferential wall portion 212 can be reliably pressed against the upper surface of the second case 22.

In the vane pump 1 of this embodiment, the rotor 3 is controlled to rotate at a constant rotational speed. That is, the motor 5 that rotates the rotor 3 is controlled to rotate at a constant rotational speed.

Even if the driving power of the vane pump 1 is constant, the rotation speed of the vane pump 1 may fluctuate due to various factors such as fluctuations in frictional resistance. On the other hand, depending on applications of the vane pump 1, it may be necessary to prevent fluctuations in the rotation speed. Therefore, in such case, constant rotation control is performed to control the rotation speed to be constant.

The vane pump 1 of this embodiment is used, for example, in an evaporative fuel processing apparatus provided with a leak diagnosis unit for evaporative fuel, That is, for example, the vane pump 1 is used as a decompression pump for depressurizing a diagnosis system including a canister.

For example, the leak diagnosis unit is configured to diagnose a leak of the diagnosis system based on pressure change when the pressure in the system is reduced by the vane pump 1.

The present embodiment provides the following functions and advantages.

In the vane pump 1, the casing 2 has the flange 23 at the intermediate position and the flange 23 is fixed to the fixed member 6. As a result, even when the casing 2 expands or contracts due to a temperature change, uneven deformation of the casing due to a difference in linear expansion coefficient between the casing 2 and the fixed member 6 can be easily suppressed. That is, even if the temperature of the casing 2 is changed due to the influence of heat generation caused by sliding of the rotor 3, heat transfer from the motor 5, or a change in the environmental temperature, it is easy to suppress uneven deformation of the casing 2. As a result, the amount of deformation of the pump chamber 20 can be suppressed. Therefore, it is possible to suppress fluctuations in discharge pressure of the vane pump 1 due to temperature changes.

The above-mentioned functions and advantages will be described in comparison with a vane pump 9 of a comparative example shown in FIGS. 7 to 9.

Figure 7:
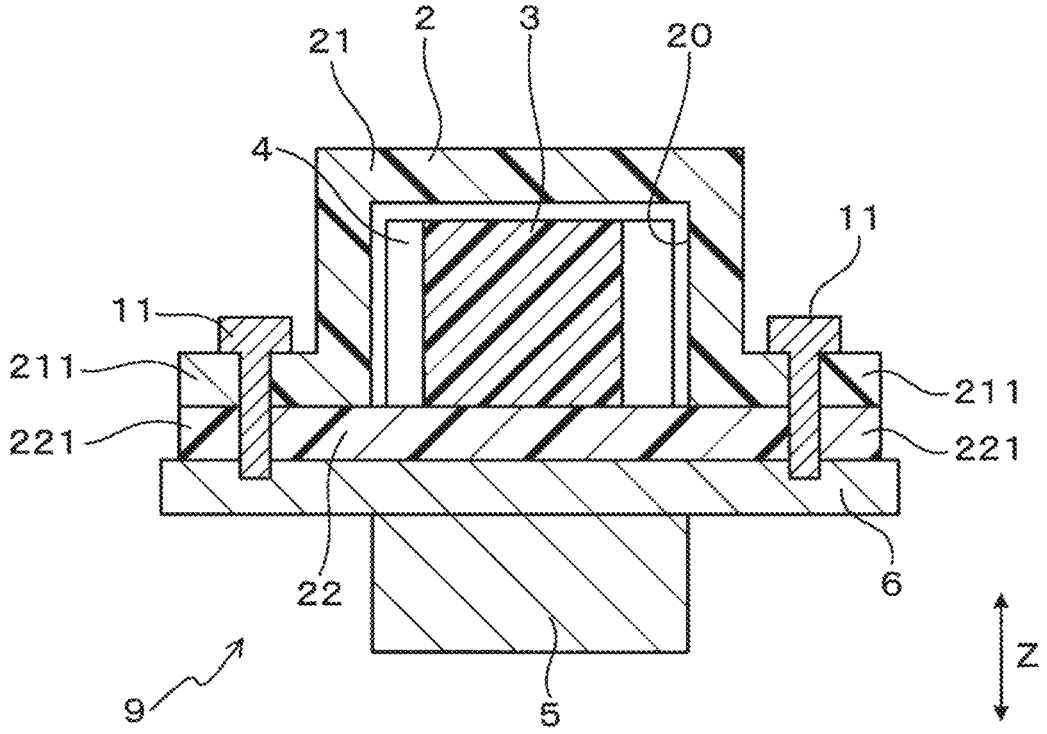
FIG. 7 is a cross-sectional explanatory view of a vane pump in a comparative example.

In the vane pump 9 of the comparative example, as shown in FIG. 7, the first flange 211 protrudes from the casing 2 at the lower end of the pump chamber 20. That is, the lower end surface of the first flange 211 is located on the same plane as the lower end of the pump chamber 20. Further, the second flange 221 is arranged on a down side of the first flange 211. Therefore, in the vane pump 9 of the comparative example, neither the first flange 211 nor the second flange 221 protrude at the intermediate position between both ends of the pump chamber 20 in the axial direction Z. That is, neither the first flange 211 nor the second flange 221 correspond to the above-mentioned "flange at the intermediate position".

In the vane pump 9 having such configuration, there are the following concerns. That is, when the casing 2 is fixed to the fixed member 6 having a relatively small linear expansion coefficient, the casing 2 may be deformed unevenly due to the difference in the linear expansion coefficient between the casing 2 and the fixed member 6. For example, at high temperatures, the casing 2 expands more than the fixed member 6.

Figure 8:
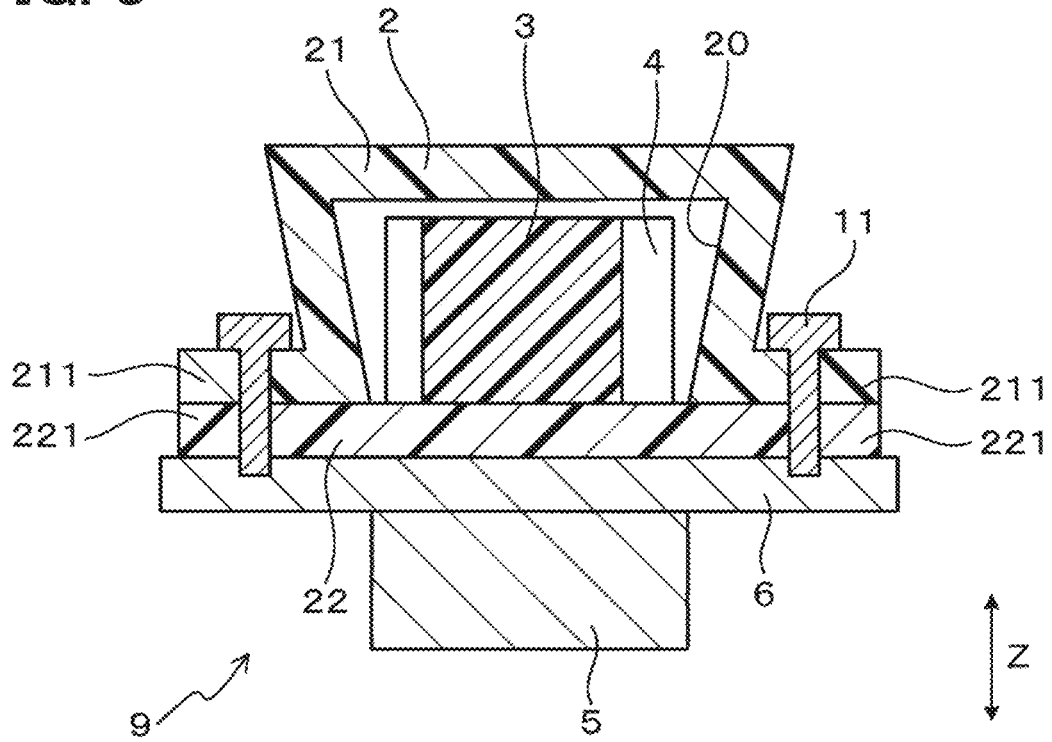
FIG. 8 is a cross-sectional explanatory view of the vane pump of the comparative example at a high temperature.
Figure 9:
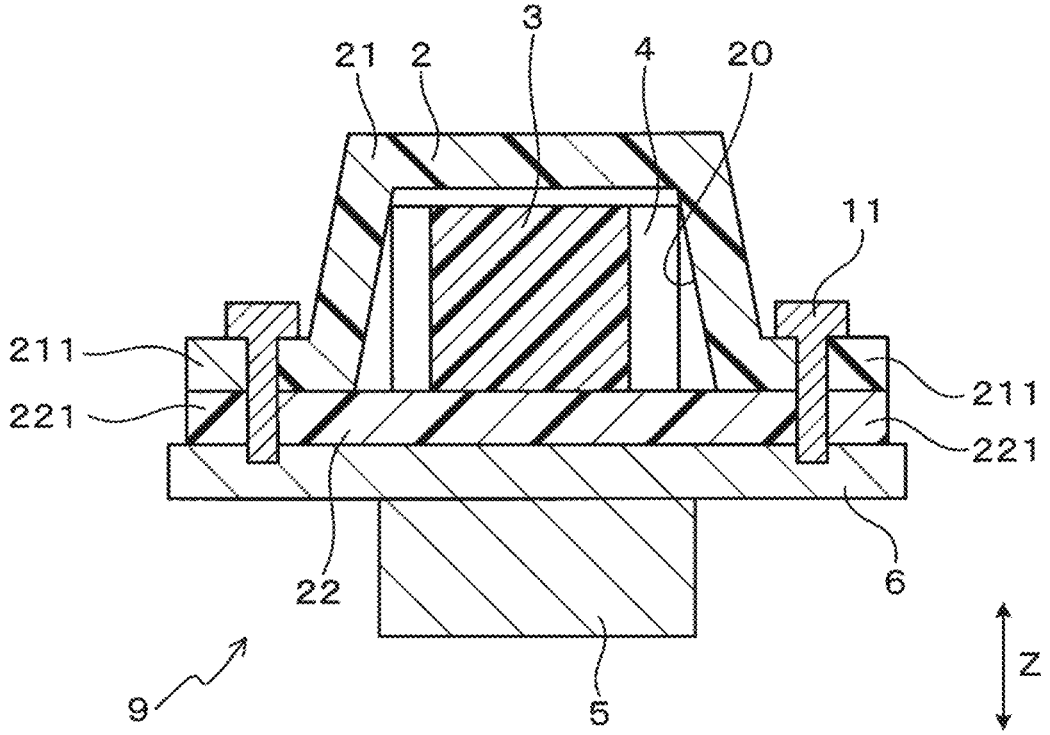
FIG. 9 is a cross-sectional explanatory view of the vane pump of the comparative example at a low temperature.

At this time, as shown in FIG. 8, a portion of the casing 2 in the vicinity of the first flange 211 and the second flange 221 that are fixed by the screws 11 is restricted from deforming by the fixed member 6. On the other hand, a portion of the casing 2 away from the first flange 211 and the second flange 221 are likely to deform.

In this case, dimensional change of the pump chamber 20 differs in the axial direction Z, and uneven deformation of the pump chamber 20 is likely to occur. Then, the clearance between the inner surface of the pump chamber 20 and the rotor 3 and between the inner surface and the vanes 4 is likely to fluctuate greatly. As a result, fluctuations in the discharge pressure of the vane pump 1 are likely to occur.

Further, at a low temperature, the casing 2 contracts more than the fixed member 6. Therefore, as shown in FIG. 9, the pump chamber 20 is contracted more in a portion farther from the first flange 211 and the second flange 221 that are fixed to the fixed member 6 than in a portion closer to the first flange 211 and the second flange 221. As a result, uneven deformation of the pump chamber 20 is likely to occur as in the high temperature. Therefore, similarly, discharge pressure of the vane pump 1 is likely to fluctuate.

On the other hand, in the vane pump 1 of the present embodiment, as shown in FIG. 4, the casing 2 has the flange 23 at the intermediate position. That is, a difference in the distance between the flange 23 fixed to the fixed member 6 and each of positions of the casing 2 is small. Therefore, even if the casing 2 expands or contracts along with the temperature change, the uneven deformation of the pump chamber 20 can be suppressed.

Figure 5:
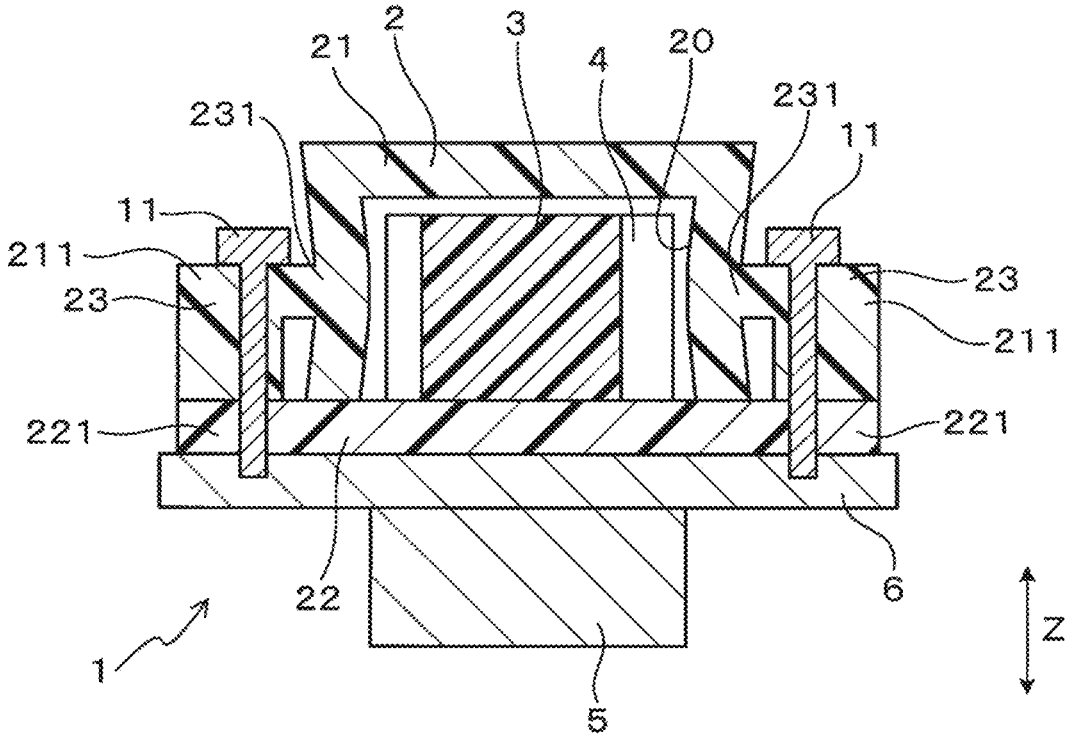
FIG. 5 is a cross-sectional explanatory view of the vane pump of the first embodiment at a high temperature.

That is, as shown in FIG. 5, for example, even when the casing 2 expands at a high temperature and is slightly deformed, the pump chamber 20 is less likely to unevenly deform. Therefore, the clearance between the inner surface of the pump chamber 20 and the rotor 3 and the clearance between the inner surface and each of the vanes 4 are less likely to fluctuate. As a result, fluctuations in the pump discharge pressure can be suppressed.

Figure 6:
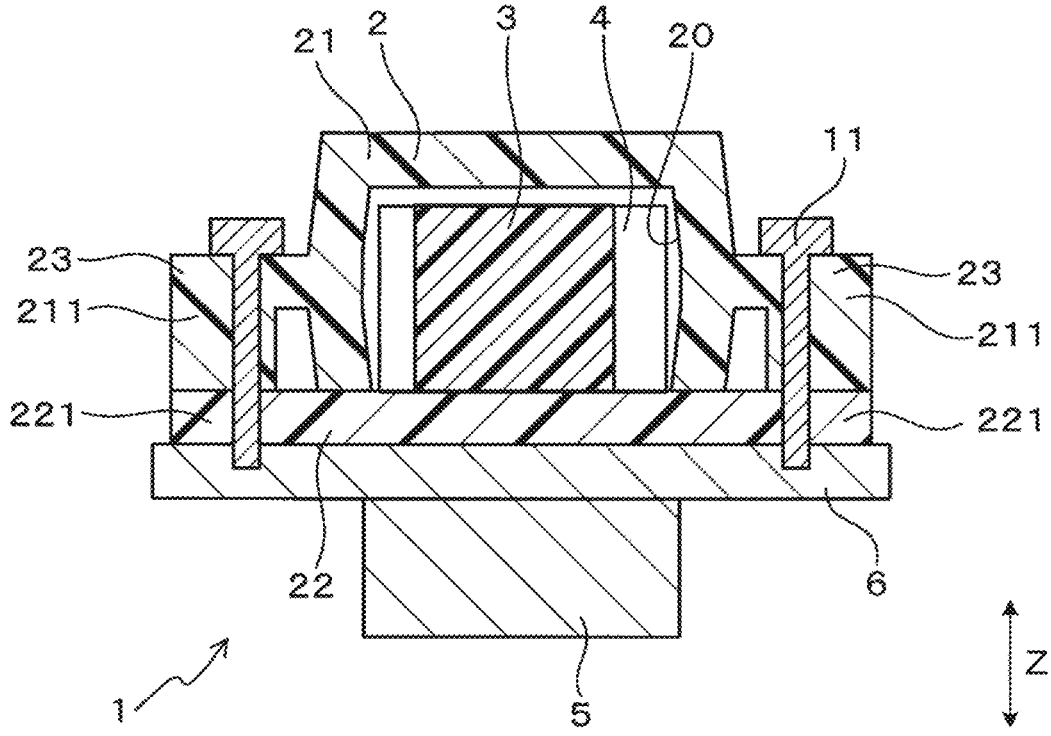
FIG. 6 is a cross-sectional explanatory view of the vane pump of the first embodiment at a low temperature.

Also in case that the casing 2 contracts at a low temperature and is slightly deformed, as shown in FIG. 6, the pump chamber 20 is less likely to unevenly deform. Therefore, as in the above, fluctuations in the pump discharge pressure can be suppressed.

The first case 21 and the second case 22 constituting the casing 2 are fixed to each other and fixed to the fixed member 6 at the first flange 211 and the second flange 221. The first flange 211 is the flange 23 at the intermediate position. As a result, an assembly of the casing 2 and a fixation to the fixed member 6 are performed at the same positions. Therefore, it is possible to improve productivity as well as simplification of the vane pump 1.

Further, at least a part of the joint portion 231 of the flange 23 at the intermediate position is located on each side of the central plane F. Thereby, the uneven deformation of the pump chamber 20 due to the temperature change can be suppressed more effectively.

Further, the vane pump 1 is controlled to rotate at a constant rotational speed such that the rotational speed of the rotor 3 is constant. This makes it possible to suppress fluctuations in the pump discharge pressure. Then, in the vane pump 1 that performs such control, the uneven deformation of the pump chamber 20 along with the temperature change is suppressed. Thus, the fluctuation in the pump discharge pressure can be effectively suppressed.

Further, as described above, when the vane pump 1 is used in the fuel processing apparatus provided with the leak diagnosis unit, it is important to keep the pump discharge pressure, that is, to keep the negative pressure constant. This is because a high accurate leak diagnosis becomes difficult if the pump discharge pressure fluctuates. Therefore, the constant rotation control as described above is performed. As a result, the pump discharge pressure can be kept constant and the accuracy of leak diagnosis can be improved. However, even when the rotation speed of the rotor 3 is kept constant, the pump discharge pressure may be affected by a deformation of the pump chamber 2 along with a deformation of the casing 2, Therefore, in the vane pump 1 that performs constant rotation control, a configuration in which the flange 23 at the intermediate position is provided as in the present embodiment is preferable from the viewpoint that the pump discharge pressure can be kept constant more accurately.

As described above, according to the present embodiment, it is possible to provide a vane pump that can suppress fluctuations in discharge pressure due to temperature changes.

Second Embodiment

Figure 10:
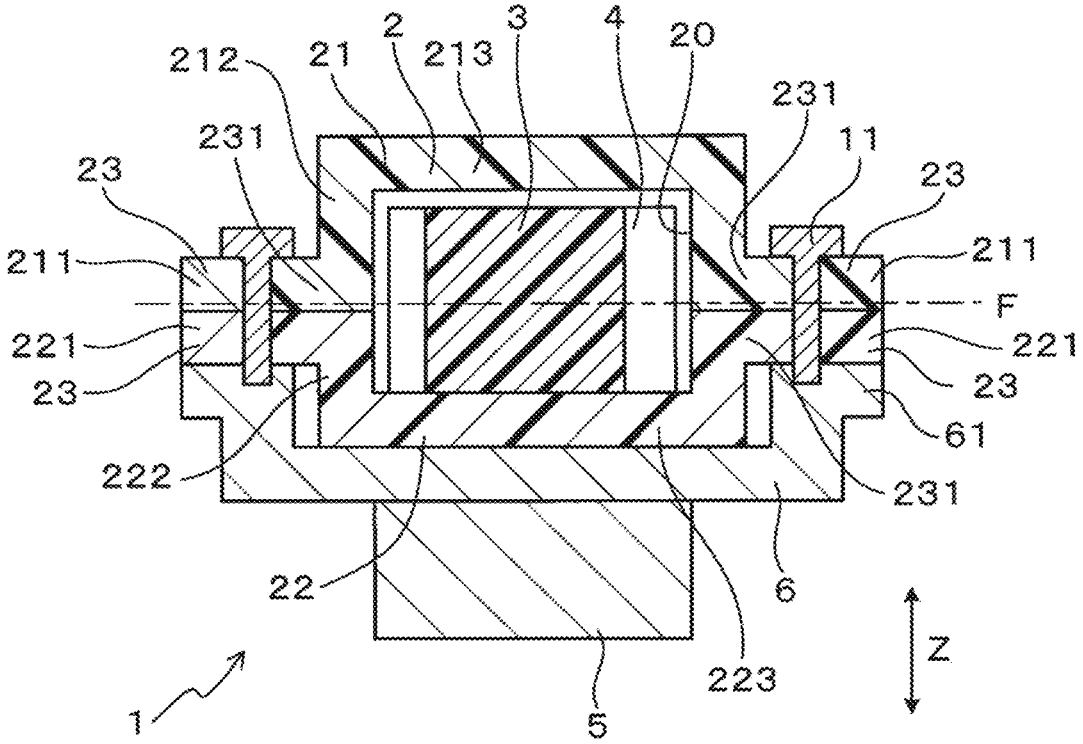
FIG. 10 is a cross-sectional explanatory view of a vane pump according to the second embodiment.

In this embodiment as shown in FIG. 10, both of the first flange 211 of the first case 21 and the second flange 221 of the second case 22 are flange 23 at the intermediate position.

In the vane pump 1 of the present embodiment, the second case 22 also has an outer circumferential wall portion 222. That is, the second case 22 has the outer circumferential wall portion 222 that has a substantially cylindrical shape and a bottom plate portion 223 connected to the lower end of the outer circumferential wall portion 222. The second flange 221 protrudes outward from the upper end of the outer circumferential wall portion 222. Further, in the first case 21, the first flange 211 protrudes outward from the lower end of the outer circumferential wall portion 212.

Further, the fixed member 6 has a contact portion 61 in contact with the lower surface of the second flange 221. The contact portion 61 of the fixed member 6 is located above a portion of the fixed member 6 located inward of the contact portion 61.

In this embodiment, as described above, both the first flange 211 and the second flange 221 form the flange 23 at the intermediate position. Further, at least a part of the joint portion 231 of the flange 23 at the intermediate position is located on each side of the central plane F.

Other portions are the same as in the first embodiment.

Those of reference numerals used in the second and subsequent embodiments which are the same reference numerals as those used in the above-described embodiments denote the same components as in the previous embodiments unless otherwise indicated.

Figure 11:
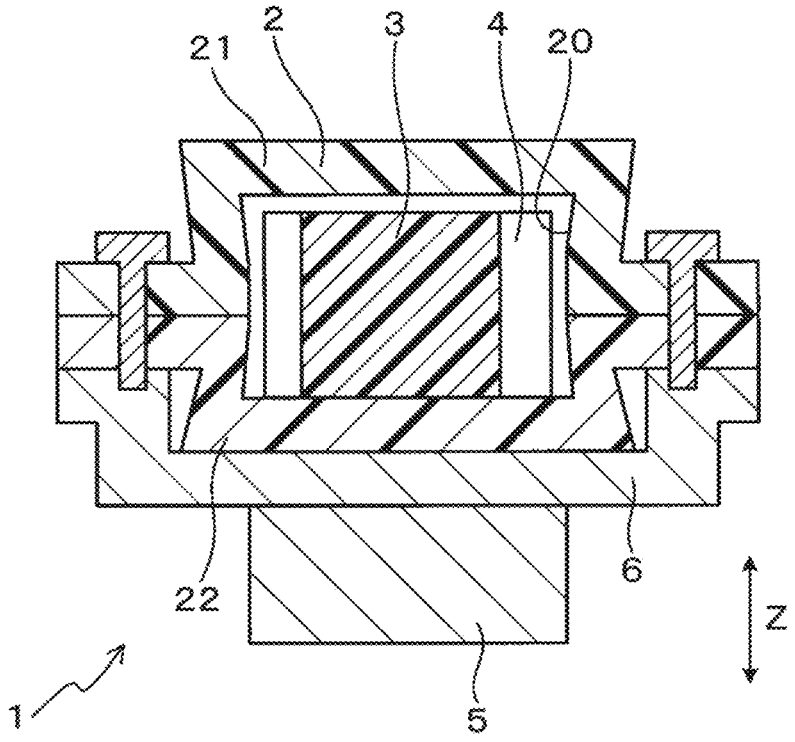
FIG. 11 is a cross-sectional explanatory view of the vane pump of the second embodiment at a high temperature.
Figure 12:
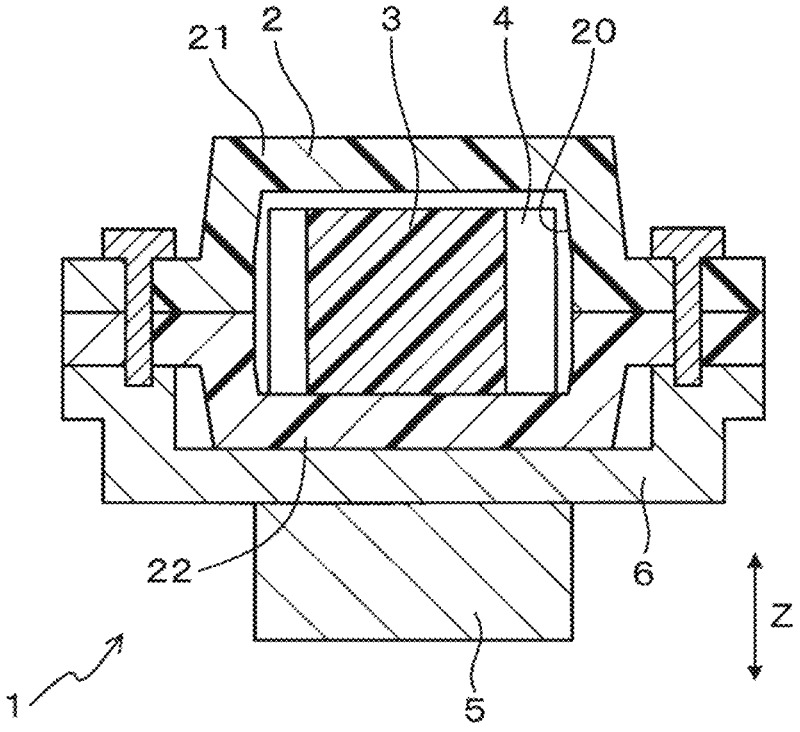
FIG. 12 is a cross-sectional explanatory view of the vane pump of the second embodiment at a low temperature.

Also in this embodiment, as shown in FIGS. 11 and 12, it is possible to suppress uneven deformation of the pump chamber 20 due to a temperature change and suppress fluctuations in the pump discharge pressure.

That is, as shown in FIG. 11, for example, even when the casing 2 expands at a high temperature and is slightly deformed, the pump chamber 20 is less likely to unevenly deform. Therefore, the clearance between the inner surface of the pump chamber 20 and the rotor 3 and the clearance between the inner surface and each of the vanes 4 are less likely to fluctuate. As a result, fluctuations in the pump discharge pressure can be suppressed.

Also in case that the casing 2 contracts at a low temperature and is slightly deformed, as shown in FIG. 12, the pump chamber 20 is less likely to unevenly deform. Therefore, as in the above, fluctuations in the pump discharge pressure can be suppressed.

In addition, this embodiment has the same functions and advantages as in the first embodiment.

Third Embodiment

Figure 13:
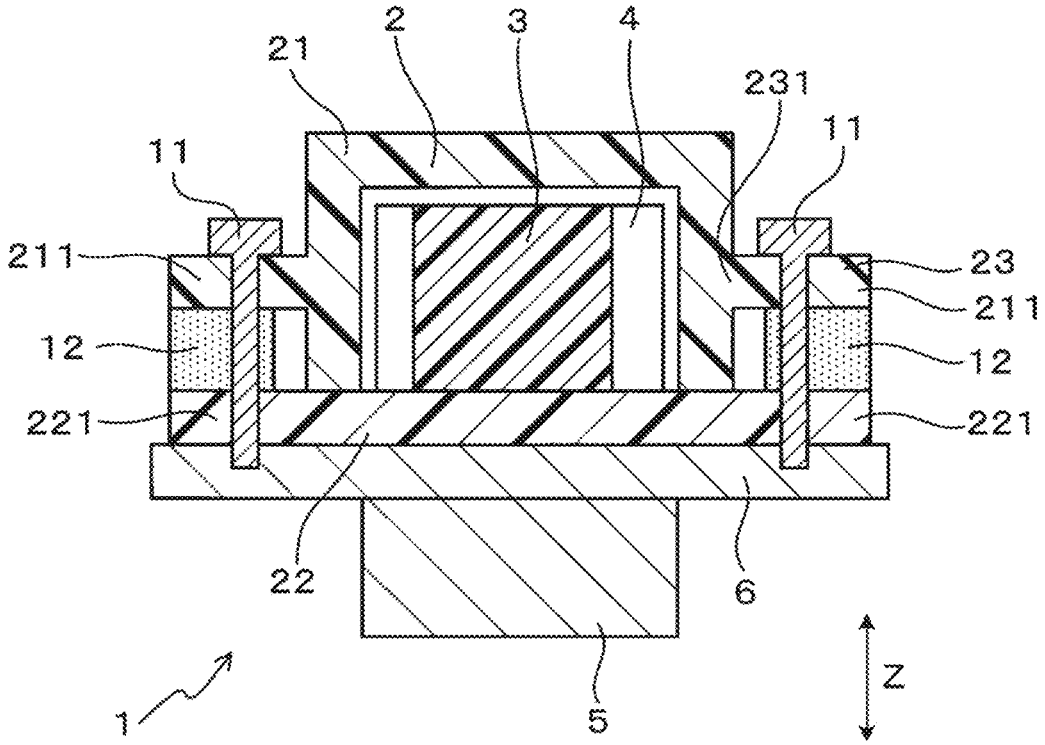
FIG. 13 is a cross-sectional explanatory view of a vane pump of the third embodiment.

In this embodiment as shown in FIG. 13, a spacer 12 is interposed between the first flange 211 and the second flange 221.

The screws 11 pass through the first flange 211, the spacer 12, and the second flange 221 and fixed to the fixed member 6. The spacer 12 can be made of, for example, the same resin as the first case 21 and the second case 22.

The other configuration is the same as that of the first embodiment, and exhibits the same functions and advantages.

As in this embodiment, the first flange 211 and the second flange 221 may be configured not to be in direct contact with each other.

Fourth Embodiment

Figure 14:
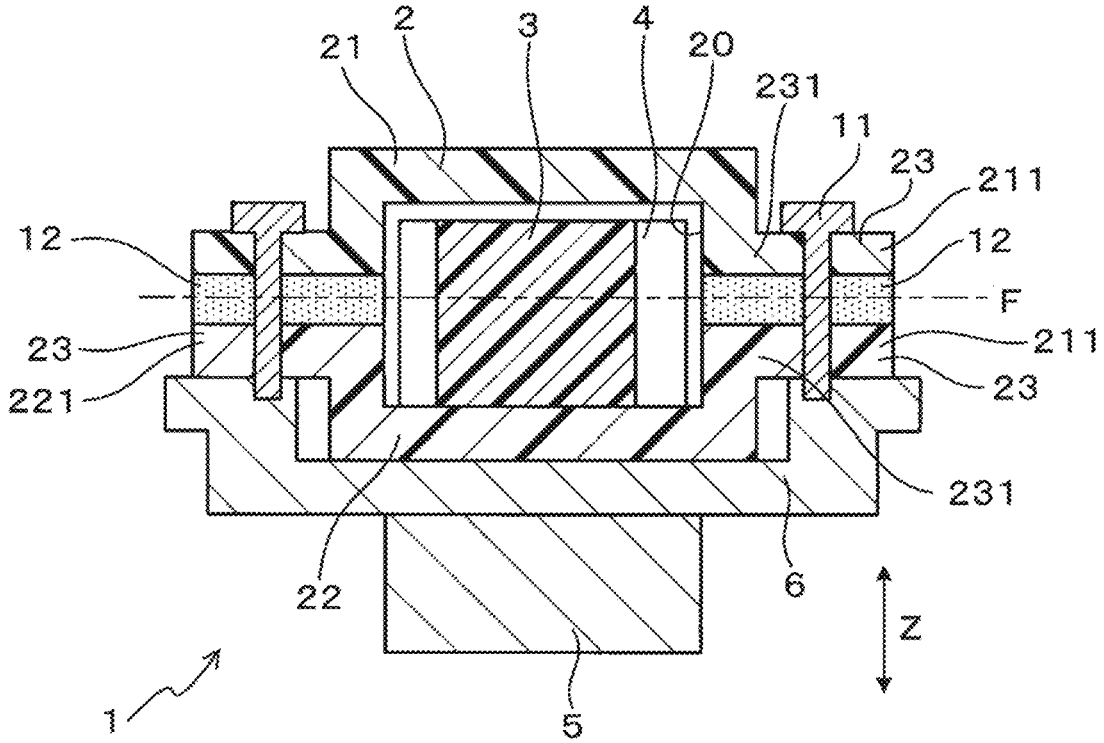
FIG. 14 is a cross-sectional explanatory view of a vane pump of the fourth embodiment.

In this embodiment as shown in FIG. 14, the spacer 12 is interposed between the first flange 211 and the second flange 221.

However, in the present embodiment, as in the second embodiment, both the first flange 211 and the second flange 221 serve as the flange 23 at the intermediate position, and the spacer 12 is interposed therebetween. Further, the spacer 12 is formed in an annular shape extending entirely in the circumference direction of the pump chamber 20 when viewed in the axial direction Z.

In this embodiment, the central plane F passes through the spacer 12. The first flange 211, which serves the flange 23 at the intermediate position, and the second flange 221, which also serves as the flange 23 at the intermediate position, are arranged on opposite sides of the central plane F, respectively.

In addition, this embodiment has the same functions and advantages as in the first embodiment.

The present disclosure is not limited to the respective embodiments described above, and various modifications may be adopted within the scope of the present disclosure without departing from the spirit of the disclosure.

Although the present disclosure has been described in accordance with the embodiments, it is understood that the present disclosure is not limited to such embodiments or structures. The present disclosure encompasses various modifications and variations within the scope of equivalents. In addition, while the various elements are shown in various combinations and configurations, which are exemplary, other combinations and configurations, including more, less or only a single element, are also within the spirit and scope of the present disclosure.

What is claimed is:

1. A vane pump comprising:

a casing defining a pump chamber therein;

a rotor disposed in the casing and configured to eccentrically rotate relative to the casing around a rotational axis;

a plurality of vanes configured to rotate together with the rotor to slidably move on an inner surface of the casing;

a motor configured to rotate the rotor; and a fixed member to which both the motor and the casing are fixed, wherein the casing has an outer side wall surface and a flange, the flange protrudes outward from the outer side wall surface at an intermediate position between both ends of the pump chamber in a rotational axis direction of the rotor, the flange is fixed to the fixed member at a plurality of positions, the fixed member has a linear expansion coefficient that is different from that of the casing, and the flange is away from outer side wall surface pump chamber in the rotational axis direction.

2. The vane pump according to claim 1, wherein the casing includes a first case and a second case that are fixed to each other in the rotational axis direction, the first case includes a first flange protruding outward from the outer side wall surface, the second case includes a second flange protruding outward from the outer side wall surface, the first flange and the second flange are fixed to each other and fixed to the fixed member, and at least one of the first flange or the second flange serves as the flange at the intermediate position.

3. The vane pump according to claim 1, wherein a central plane is defined as a plane that is perpendicular to the rotational axis and passes through a middle position of the pump chamber in the rotational axis direction, the flange includes a joint portion connected to the outer side wall surface of the casing, and the central plane passes through the joint portion.

4. The vane pump according to claim 1, wherein the rotor is controlled to rotate at a constant rotational speed.

5. The vane pump according to claim 1, wherein:

a central plane is defined as a plane that is perpendicular to the rotational axis and passes through a middle position of the pump chamber in the rotational axis direction, the central plane passes through the flange.

6. A vane pump comprising:

a casing defining a pump chamber therein;

a rotor disposed in the casing and configured to eccentrically rotate relative to the casing around a rotational axis;

a plurality of vanes configured to rotate together with the rotor to slidably move on an inner surface of the casing;

a motor configured to rotate the rotor; and a fixed member to which both the motor and the casing are fixed, wherein the casing has an outer side wall surface and a flange, the flange protrudes outward from the outer side wall surface at an intermediate position between both ends of the pump chamber in a rotational axis direction of the rotor, the flange is fixed to the fixed member at a plurality of positions, the fixed member has a linear expansion coefficient that is different from that of the casing, the flange includes a joint portion connected to the outer side wall surface of the casing, and a whole of the joint portion of the flange is away from both ends of the pump chamber in the rotational axis direction.

7. The vane pump according to claim 6, wherein a central plane is defined as a plane that is perpendicular to the rotational axis and passes through a center of the pump chamber in the rotational axis direction, and the central plane passes through the flange.

8. A vane pump comprising:

a casing defining a pump chamber therein;

a rotor disposed in the casing and configured to eccentrically rotate relative to the casing around a rotational axis;

a plurality of vanes configured to rotate together with the rotor to slidably move on an inner surface of the casing;

a motor configured to rotate the rotor; and a fixed member to which both the motor and the casing are fixed, wherein the casing has an outer side wall surface and a flange, the flange protrudes outward from the outer side wall surface at an intermediate position between both ends of the pump chamber in a rotational axis direction of the rotor, the flange is fixed to the fixed member at a plurality of positions, and the fixed member has a linear expansion coefficient that is different from that of the casing, a central plane is defined as a plane that is perpendicular to the rotational axis and passes through a center of the pump chamber in the rotational axis direction, the flange includes a joint portion connected to the outer side wall surface of the casing, the central plane passes through the joint portion, and a whole of the joint portion of the flange is away from both ends of the pump chamber in the rotational axis direction.

* * * * *